United States Patent [19]

Deverrewaere

[11] 4,276,585

[45] Jun. 30, 1981

[54] RECTANGULAR-OPENING SEALED BEAM UNITS FOR AUTOMOBILE LIGHTING

[75] Inventor: Alain Deverrewaere, La Varenne, France

[73] Assignee: Cibie Projecteurs, Bobigny, France

[21] Appl. No.: 17,305

[22] Filed: Mar. 5, 1979

[30] Foreign Application Priority Data

Mar. 7, 1978 [FR] France ..... 78 06437

[51] Int. Cl.[3] ..... F21V 13/04

[52] U.S. Cl. ..... 362/308; 362/329; 313/113

[58] Field of Search ..... 362/61, 80, 267, 296, 362/307, 308, 309, 310, 311, 328, 329, 83, 327, 335, 336, 337; 313/113, 114, 115, 116

[56] References Cited

U.S. PATENT DOCUMENTS

| | | | |
|---|---|---|---|
| 2,486,558 | 11/1949 | Franck | 362/337 |
| 2,594,753 | 4/1952 | Falge | 313/113 |
| 3,414,762 | 12/1968 | Wyzykowski | 362/80 |

FOREIGN PATENT DOCUMENTS

| | | | |
|---|---|---|---|
| 696657 | 9/1940 | Fed. Rep. of Germany | 362/83 |
| 1259410 | 8/1961 | France | 362/61 |
| 1518841 | 3/1968 | France | 362/61 |
| 253890 | 4/1927 | United Kingdom | 362/83 |

*Primary Examiner*—L. T. Hix
*Assistant Examiner*—Alan Mathews
*Attorney, Agent, or Firm*—Alan H. Levine

[57] ABSTRACT

The invention relates to sealed beam units for automobile vehicles and more particularly to a sealed beam unit with rectangular opening contour, characterized:

(a) by a reflector limited to the optically useful parabolic surface corresponding to the opening contour chosen, (b) by a glass of enveloping form comprising a front face and connecting parts connecting the front face to the outer edge of the reflector.

The invention brings advantages in manufacture and in constitution.

4 Claims, 4 Drawing Figures

RECTANGULAR-OPENING SEALED BEAM UNITS FOR AUTOMOBILE LIGHTING

The present invention relates to rectangular-opening sealed beam units for automobile lighting, and more particularly to sealed beam units whose opening contour has a width which is substantially larger than its height.

The term sealed beam until designates a unit comprising a reflector, at least one light source associated with this reflector and a front glass for closing the opening of the reflector and serving to diffuse the light rays emitted by the source and returned by the reflector. Embodiments are known where the front glass is mounted directly on the reflector. Embodiments are also known in which an intermediate piece is interposed between the front glass and the reflector.

Sealed beam units having a rectangular opening, i.e. a rectangular front glass, have been proposed for a long time. One of the first French vehicles equipped with such sealed beam units was the AMI 6 CITROEN, and Applicants' French Pat. No. 1 259 410 corresponding thereto, describing the sealed beam unit of this vehicle, with rectangular opening, may be mentioned. Mention may also be made of French Pat. No. 1 518 841.

As far as their structure is concerned, such sealed beam units of the prior art comprise a reflector made of stamped metal comprising a reflecting parabolic surface portion forming reflector mirror, and wall portions (connecting sides) serving to limit the volume of the sealed beam unit and connecting the parabolic wall to the front plane of the reflector; the glass extends near this frontal plane. FIG. 1 of the accompanying drawings illustrates, in perspective, such as embodiment: the reflector R comprises a rear portion F forming the actual reflector and two horizontal sides J. The unit is closed by a substantially flat glass G.

As a general rule, for sealed beam units for automobiles, the reflector is made of stamped metal and the glass of moulded glass.

Developments in automobile techniques now call upon rectangular sealed beam units of more and more reduced height and greater width, for example with a width/height ratio greater than 3. Under these conditions, the depth of stamping necessary for making metal reflectors increases with the larger dimension of opening; with the present stamping techniques, it is becoming difficult and very expensive to stamp a reflector with its parabolic rear wall and its side walls for connection to the frontal plane, in one piece. It is also expensive to manufacture the side walls separately and mount them on the stamped reflector separately.

In addition to the difficulties and drawbacks in manufacture, the sealed beam units of the prior art present drawbacks coming from their very constitution; essentially, the metal sides have harmful effects from the optical point of view, in that they cause an absorption of an appreciable part of the light flux emitted by the source, and also because they provoke untimely parasitic reflections which produce undesirable rays leaving the headlight.

It is an object of the invention to propose a novel rectangular-opening sealed beam unit structure which remedies both the manufacturing drawbacks and the constitutional ones.

The new sealed beam unit according to the invention is characterised:

(a) by a stamped reflector essentially limited to the optically useful parabolic surface corresponding to the rectangular opening contour;

(b) by a front glass of enveloping shape comprising a rectangular front face and connecting parts taking the exact form of the outer edge of the reflector.

The invention will be more readily understood on reading the following descriptions with reference to the accompanying drawings, in which.

Figure 1:
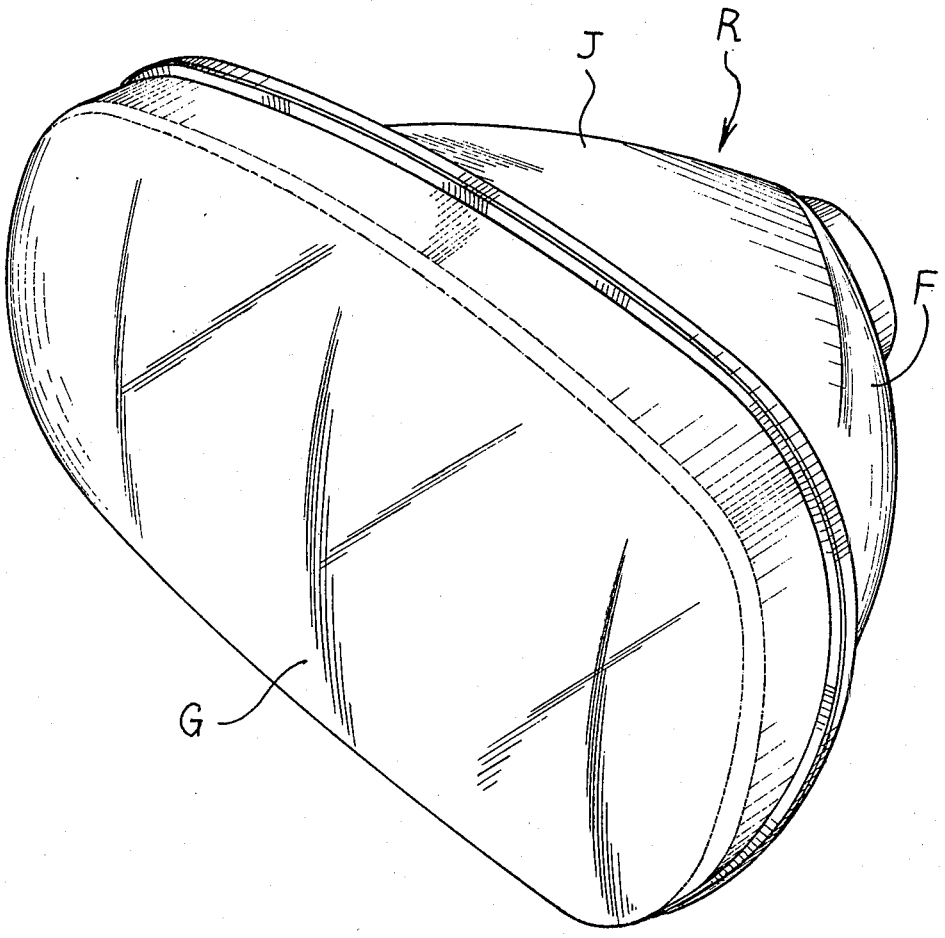
FIG.1 PRIOR ART
FIG. 1 shows, in perspective, a conventional rectangular opening sealed beam unit.
Figure 2:
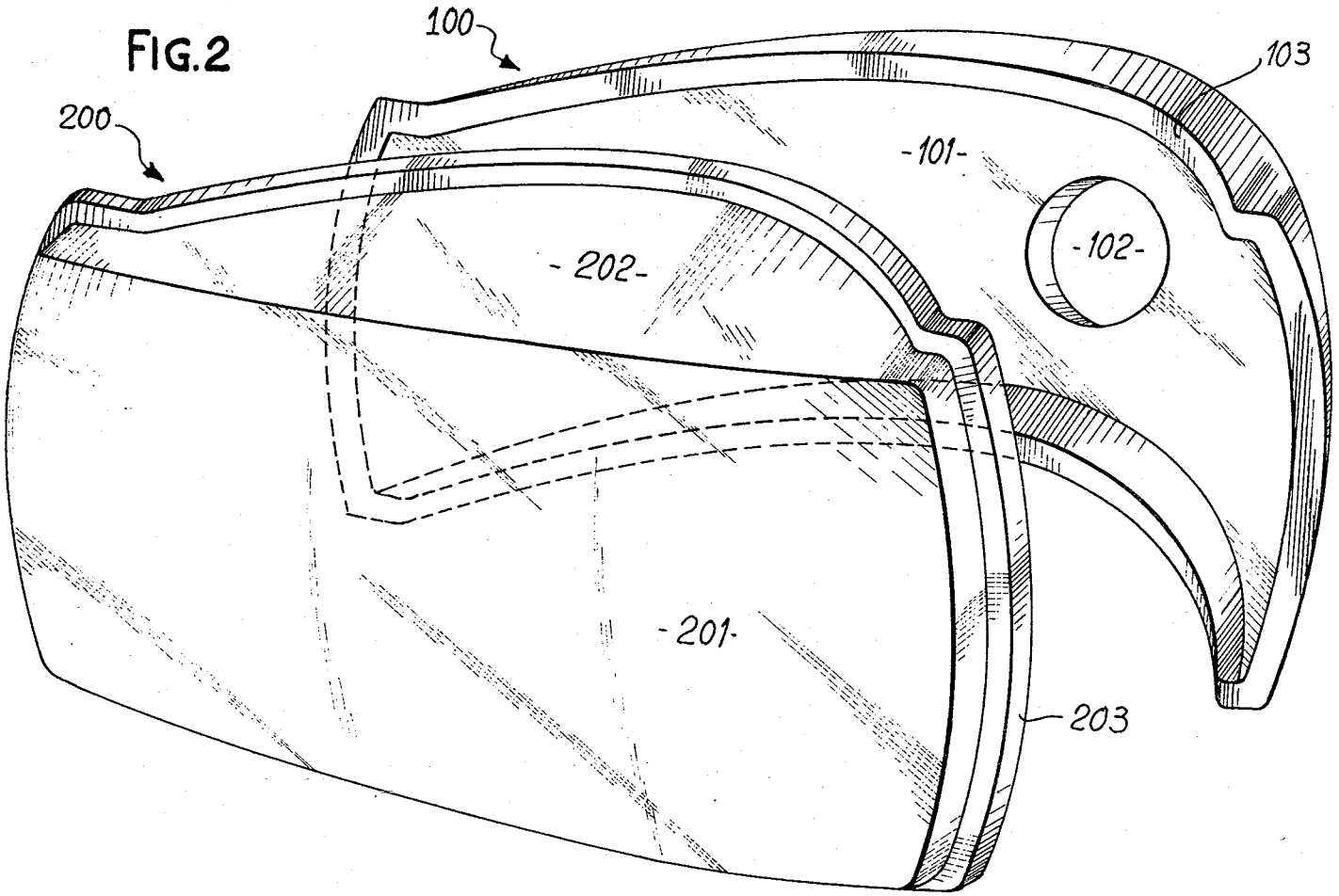
FIG. 2 shows, in perspective, the reflector and the front glass of a rectangular-opening sealed beam unit according to the invention.
Figure 3:
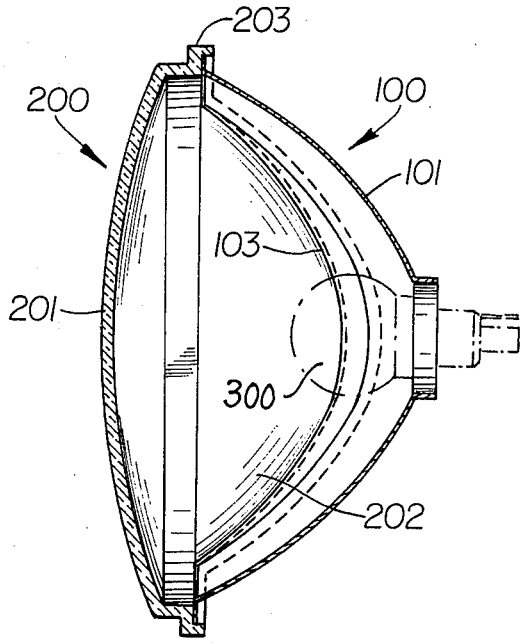
FIG. 3 is a view in horizontal section of such a sealed beam unit.
Figure 4:
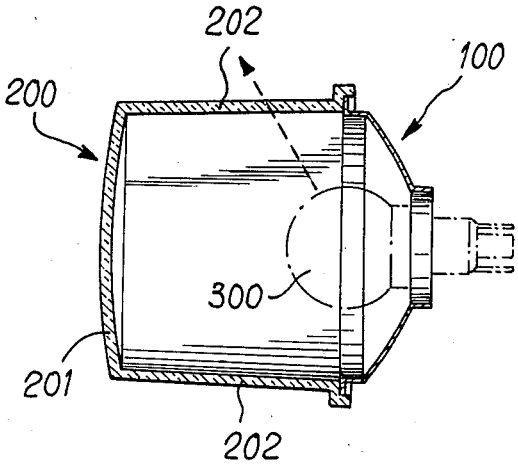
FIG. 4 is a view in vertical section.

Referring now to the drawings, FIGS. 2 to 4 show the reflector 100 of the sealed beam unit according to the invention which is solely constituted by a thin parabolic rear wall 101 through which a lamp assembly opening 102 passes at its apex. It is provided with a flange 103 on its outer contour. Such a shape is very easily made by stamping and bending a metal sheet, despite the possibly very large dimensions of the horizontal diameter of the reflector.

The glass 200 is provided with a rectangular front surface 201 and with connecting sides 202 taking the exact form of the flange 103.

On its outer contour, it comprises a flange or bead 203. Such a glass may easily be made by moulding, particularly by moulding plastics materials such as polycarbonates.

The assembling of the reflector 100 and the glass 200 by their homologous edges 103, 203 may be effected in any suitable manner with or without the interposition of a seal; a tight gluing may advantageously be used with the aid of an epoxide resin.

The sealed beam unit is completed by a lamp 300 mounted in any manner known per se on the opening 102 of the reflector 100.

FIG. 4 clearly shows that the sides 202 forming integral part of the glass 200 do not oppose the path of the direct light rays issuing from lamp 300, due to the translucence of these sides: essentially, there is neither heating of the sides 202 under the effect of the lamp 300, nor parasitic reflection on the walls 202.

This translucence of the sides 202 may, of course, be used to advantage by serving, totally or partly, as light window forming indicator lamp if necessary.

The invention is, of course, not limited to the embodiment which has been described but is extended to any variant in accordance with its spirit, and to all forms of sealed beam units or headlights substantially differing from the conventional circular form.

What is claimed is:

1. A sealed beam headlight for a motor vehicle, comprising:

(a) a metal reflector having a parabolic contour, the reflector, when viewed from the front, having a substantially rectangular shape wherein its width is greater than its height, the outer edge of the reflector including two side edge portions and upper and lower edge portions, each of the upper and lower edge portions extending rearwardly from the side edge portions along a generally arcuate path, and (b) a translucent lens covering the front of the reflector, the lens, when viewed from the front, having a substantially rectangular shape wherein its width is greater than its height, and the outer edge of the lens having a shape complementary to that of the outer edge of the reflector so that when the reflector and lens are assembled their outer edges meet.

2. A sealed beam headlight as defined in claim 1 wherein each of the reflector and lens has a width more than three times its height.

3. A sealed beam headlight as defined in claim 1 wherein the reflector is made of stamped metal.

4. A sealed beam headlight as defined in claim 1 wherein the lens is molded plastic.

* * * * *